United States Patent [19]

Naylor

[11] Patent Number: 4,542,881

[45] Date of Patent: Sep. 24, 1985

[54] CAR RAMP

[75] Inventor: Dennis Naylor, Bradford, England

[73] Assignee: David Charles Smith, East Keswick, England

[21] Appl. No.: 421,676

[22] Filed: Sep. 22, 1982

[30] Foreign Application Priority Data

Feb. 27, 1982 [GB] United Kingdom ..... 8205872

[51] Int. Cl.[4] ..... E02C 3/00

[52] U.S. Cl. ..... 254/88

[58] Field of Search ..... 254/88

[56] References Cited

U.S. PATENT DOCUMENTS

| | | | |
|---|---|---|---|
| 1,904,693 | 4/1933 | Meyers et al. | 254/88 |
| 2,076,069 | 4/1937 | Davis | 254/88 |
| 3,386,703 | 6/1968 | Thumma | 254/88 |
| 3,606,253 | 9/1971 | Wooten et al. | 254/88 |
| 3,856,264 | 12/1974 | Thumma | 254/88 |
| 4,013,268 | 3/1977 | Williams | 254/88 |
| 4,058,292 | 11/1977 | Goodrich et al. | 254/88 |

FOREIGN PATENT DOCUMENTS

| | | | |
|---|---|---|---|
| 2701514 | 7/1978 | Fed. Rep. of Germany | 254/88 |
| 1384379 | 2/1975 | United Kingdom | 254/88 |

*Primary Examiner*—Robert C. Watson

*Attorney, Agent, or Firm*—David A. Jackson; Daniel H. Bobis

[57] ABSTRACT

A ramp for a motor vehicle comprising means defining a ramp surface up which the motor vehicle wheel runs to a well into which the wheel drops and when therein is restrained from moving sideways, the ramp being collapsible to flattened condition for storage and transportation. The ramp is in three sections or frames, an upper frame, lower members to which the upper frame is pivotally connected, and a strut frame which acts as an inclined a strut keeping the upper frame at the correct angle. The frames and members can be disengaged to enable the ramp to be collapsed.

3 Claims, 7 Drawing Figures

CAR RAMP

Figure 1:
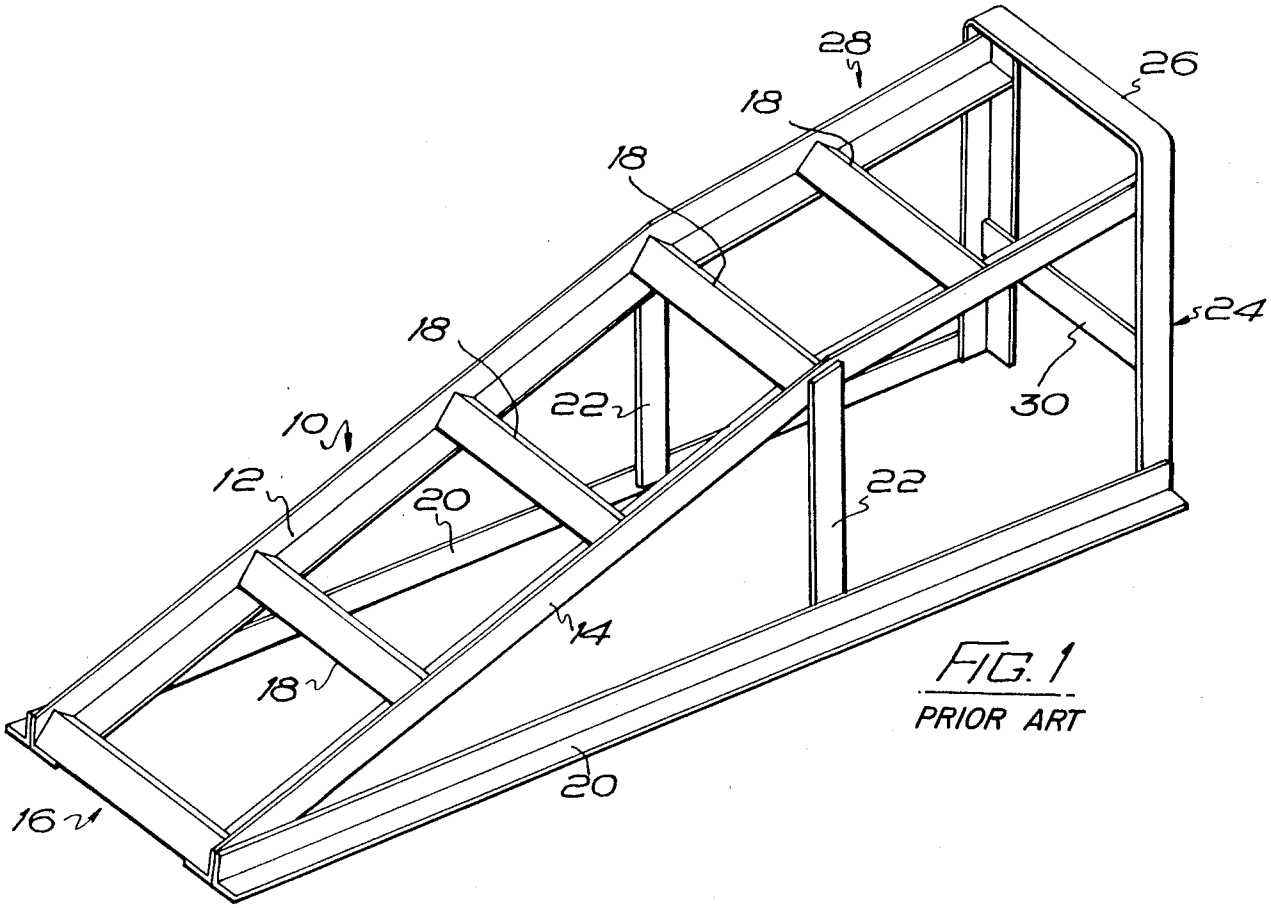
FIG. 1 PRIOR ART

This invention relates to car ramps which are used for supporting a wheel or wheels of a vehicle sufficiently clear of the ground to enable a person to slide under the vehicle for underside inspection and/or repair purposes.

The present invention is concerned with a portable manually handlable type of car ramp. The most commonly used car ramp of this type comprises a framework of metal bars welded or otherwise secured together to provide a rigid structure. Some car ramps of this nature are designed to be nested or stacked so as to take up the minimum of space when not in use, but the conventional car ramps of this type are not collapsible or dismantleable, and therefore they tend to be used only in garages as opposed to being part of a motorists kit.

The present invention is concerned with providing a car ramp which will perform the supporting function as effectively as the rigid ramp, but which will be capable of being dismantled or collapsed to a position in which it occupies much less space than in its open position, so that it will be suitable for being transported for example in the boot of a vehicle as part of a driver's emergency kit.

The conventional car ramp is provided with an upper frame which extends from the front end of the ramp upwardly and rearwardly, and at the rear the upper frame has a portion which extends parallel to the ground this portion being the "flat" on which the vehicle wheel rests. The upper frame is defined by parallel side rails which are connected by cross bars. The ramp furthermore has base rails for resting on the ground, and uprights connect the base rails with the side rails. An end frame connects the rear ends of the base and side rails, and the end frame may also serve as a stop for the vehicle wheel as it rides up the ramp surface from front to rear.

In the present invention, the ramp is provided with an upper deck portion which in use is adapted to be supported in an upwardly and rearwardly inclined position by means of a strut portion which engages or is connected to the upper deck portion at or towards the rear thereof, and at the rear of the upper deck portion there is defined a well into which the vehicle wheel locates, and the wheel is supported by means of transverse support means of the upper deck portion and/or strut portion, the said strut portion being pivotally connected to the upper deck portion or being disconnectable therefrom, or otherwise displaceable relative thereto so that the upper deck portion and strut portion can be collapsed or disassembled to a relatively flat structure suitable for transportation.

The upper deck portion preferably comprises a frame and to each side of said well are side rails which overlap the sides of the wheel when in position; the strut portion may also be a frame.

In use, the strut frame preferably meets the upper frame at an acute angle, and the said transverse support means are cross bars of the upper frame and strut frame which support the wheel when in the said well, and the bars preferably comprise two cross bars of the upper frame disposed on opposite sides of the location where the strut frame is connected to or engages the top frame, and a third cross bar which is part of the strut frame, but located under the plane of the upper frame.

It will be appreciated that to achieve this construction, the pitching between the said cross bars of the upper frame which support the wheel when in the well is greater than that between cross bars of the upper frame located towards the front end of the upper frame.

The ramp may include a base frame or base pieces, or a flexible retention member such as a chain or wire or the like to which the strut frame and upper frame are connected, pivotally or otherwise, or with which the said upper and strut frames are releasably engaged.

In a specific construction, there are base pieces of tubular or circular bar steel of U-configuration, and the upper frame is hinged to one pair of limbs of these pieces, and the strut frame is hinged to the other pair of limbs, the strut frame including bars which have reduced diameter ends forming dowells for engagement in apertures in the side rails of the upper frame, when the ramp is in the in use position. In an alternative arrangement, the bars of the strut frame are connected to the side rails of the upper frame by means of releasable screw fastenings, such as bolts or screws, locked by hexagonal nuts or wingnuts.

As will be clear from the description which follows, the invention can take any of a large number of constructions, but in each case the ramp will be dismantlable or collapsible to a relatively flat state suitable for transportation.

Embodiments of the invention will now be described, by way of example, with reference to the accompanying diagrams, wherein:

Diagram 1 is a perspective view of a conventional car ramp;

Diagram 2 is a perspective view of a car ramp according to a first preferred embodiment of my invention;

Diagram 3 shows the ramp of Diagram 2 in collapsed condition;

Diagram 4 shows in four steps how the ramp of Diagram 2 is moved between collapsed and operative positions;

Diagram 5 shows in perspective view the respective components of the ramp of Diagram 2;

Diagram 6 shows in nine figures nine alternative embodiments of the invention in diagrammatic side elevation; and Diagram 7 shows in two figures and in side elevation how the conventional ramp functions and how the ramp according to the present invention functions.

Referring to the diagrams, as can be seen clearly in diagram 1, a conventional car ramp comprises an upper frame 10, made up of side rails 12 and 4 which incline upwardly and rearwardly from the front end 16 of the ramp; the side rails 12 and 14 being connected by approximately equally spaced cross bars 18. The ramp has a pair of base rails 20 and uprights 22 are welded between the base rails and the side rails, whilst an end frame 24 of inverted U-configuration connects the ends of the base rails 20 and the side rails 12 and 14. The top 26 of the frame 24 serves as a stop for the vehicle wheel as it rides up the ramp, and the side rails 12 and 14 in the rear region 28 are made to extend horizontally or substantially so, so as to provide with the rear bars 18 and the cross piece 26 a substantially flat platform for the vehicle wheel. The frame 24 has a reinforcing cross bar 30.

The conventional ramp is made up of welded angle iron and flat iron, and is of rigid construction. The design is such that the ramps can be nested or stacked one within the other, but the ramp cannot be disassembled or collapsed and hence its use has heretofore been limited to garages and repair workshops and the like. The conventional ramp is also illustrated is FIG. A of Diagram 7.

The present invention aims at providing a collapsible or dismantleable ramp which can be suitable for being transported in the boot of a vehicle for use in the event of break-down or the like.

A first preferred embodiment of the new ramp is illustrated in Diagram 2, and will be seen to comprise an upper frame 50 defined by parallel rails 52 and 54 connected by cross bars 56, 58, 60 and 62. In the in use position, the upper frame 50 extends from the front end 64 of the ramp in an upwardly and rearwardly inclined manner. The front end has a front end tube 63. The frame 50 is pivotally connected to base pieces 66 which are of shallow U-configuration as shown in Diagram 5 and are formed of tubular rod or circular bar. The upper frame 50 is hinged to one pair of ends of the base pieces 66, and hinged to the other pair of ends is a strut frame 68 made up of parallel strut members 70 which are connected by a cross bar 74 and a reinforcement bar 75 and which are connected to a lower sleeve 72 into which the base pieces 66 pass to provide a pivotal connection. The ends of the strut members 70 which will be the upper ends in use are provided with flattened end portions 76 which have holes through which bolts or screws 77 pass, said bolts or screws also passing through apertures in the rails 52 and 54, in the in use position of the ramp. The bolts or screws are secured by manually releasable wingnuts 79; hexagonal nuts may be used instead of wingnuts and in another arrangement dowell ends on the members 70 simply releasably engage in apertures in rails 52, 54.

It will be noticed that the cross bars 60 and 62 are spaced apart by a greater distance than are the cross bars 56, 58 and 60. This greater spacing in fact creates a well for the vehicle wheel which, when in position on the ramp locates in this well, so that the rails 52 and 54 overlap the vehicle wheel (as will be explained when referring to diagram 7), and the bars 60, 62 and 74 in fact form a three point support for the wheel, keeping it firmly in position. The bar 62 prevents the wheel from going too far forward, whilst the bar 60 prevents the wheel from rolling back down the ramp. By so constructing the ramp, it has been possible to make it collapsible or disassemblable as will be clear when referring to Diagram 6.

Diagram 3 shows the ramp of Diagram 2 in collapsed condition and to explain how this condition is reached, reference is made to Diagram 4. In FIG. A of Diagram 4, the ramp of Diagram 2 is shown in side elevation in the in use position.

To collapse the ramp, after releasing bolts 77, the upper frame 50 is raised as shown in FIG. B of Diagram 4. The strut frame 68 is pivoted downwardly followed by the upper frame 50 as shown in FIG. C of Diagram 4, and FIG. D of diagram 3 shows the ramp in collapsed condition. It will be seen that it is substantially flat in this condition, taking up the minimum of space.

To erect the ramp, the reverse procedure is followed.

Diagram 5 shows the component parts of the ramp of Diagram 2, and to assemble the ramp, the upper frame 50 and strut frame 68 are positioned on the rods 66 so that the upper frame is hinged to the ends 78 of the rods, and the strut frame 68 is hinged to the ends 81 and the tubes 64 and 72 and the ends 78 and 81 are swaged together to define waisted portions to prevent the ends 78 and 81 from coming out of the tubes 64 and 72, but not affecting the pivotal connection thereby completing the assembly. As will be understood, the strut frame 68 and upper frame 50 are dimensioned so that the strut frame will fit inside the upper frame 50, and the upper frame will fit inside the base pieces 66 as indicated clearly in Diagram 3.

Referring now to Diagram 6, the nine figures illustrate different embodiments of the invention and the variety of embodiments illustrate that the invention can take many forms. For simplicity in describing the various embodiments briefly, the upper frame, strut frame and base pieces are indicated respectively by the numerals X, Y and Z.

In FIG. 1 of Diagram 9, the upper frame and strut frame X and Y are pivoted to the base pieces Z, but the strut frame Y is pivoted inwardly of the rear end of the base pieces, the strut frame Y being disengageably connected to the upper frame X.

Figure 2:
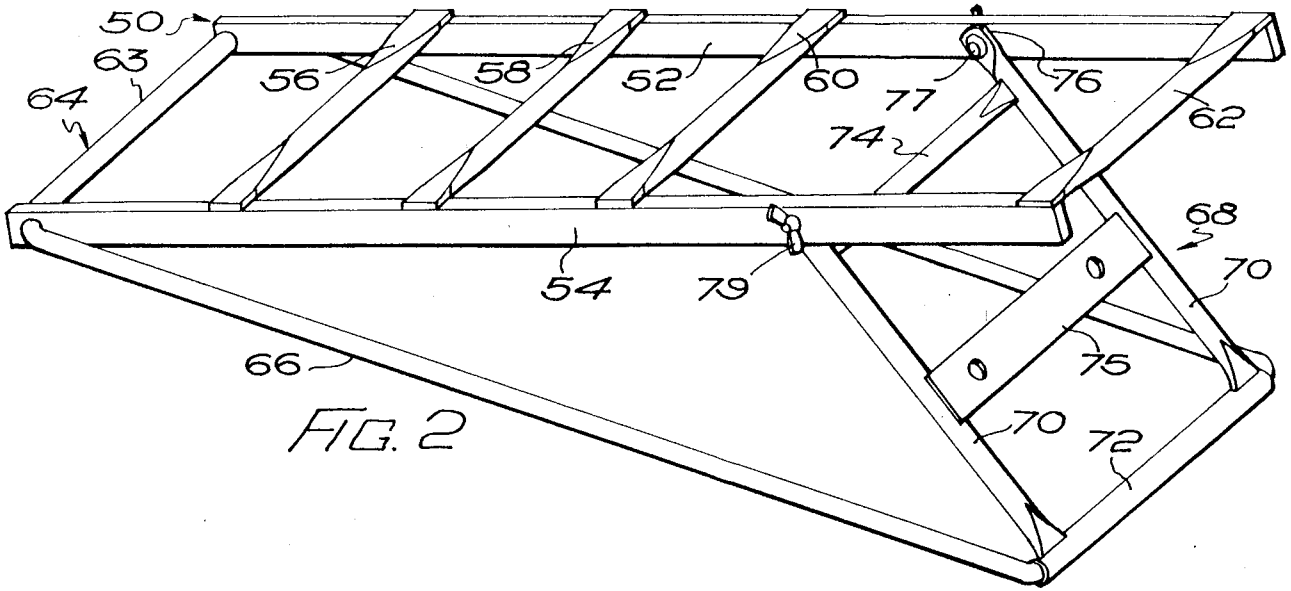

In FIG. 2 of Diagram 6, there are no base pieces, and the strut frame is disengageably connected with the upper frame X.

Figure 3:
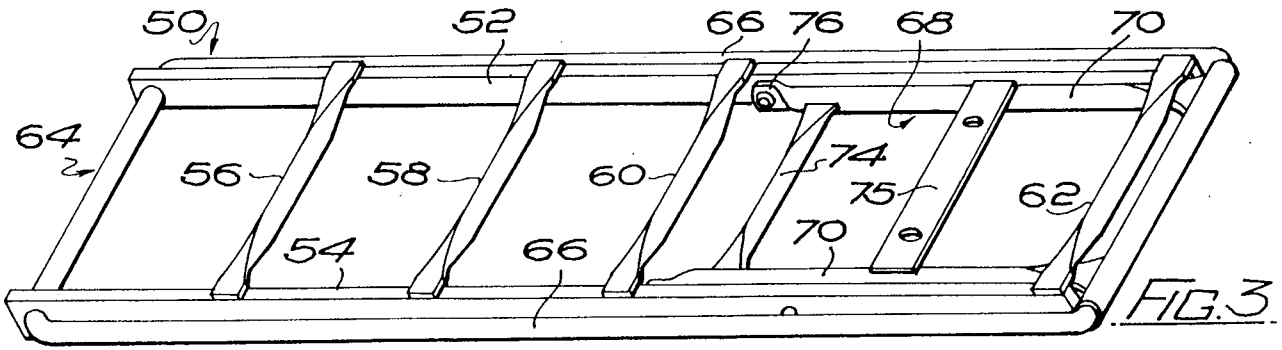

In FIG. 3 of Diagram 6, the strut frame Y and upper frame X are pivotally interconnected, and there are no base pieces.

FIGS. 2 and 3 also illustrate a modification. The dotted lines indicate a flexible tension member such as a chain or wire or the like to add extra restraining effort to prevent the frames X and Y from spreading under load in use.

Figure 4:
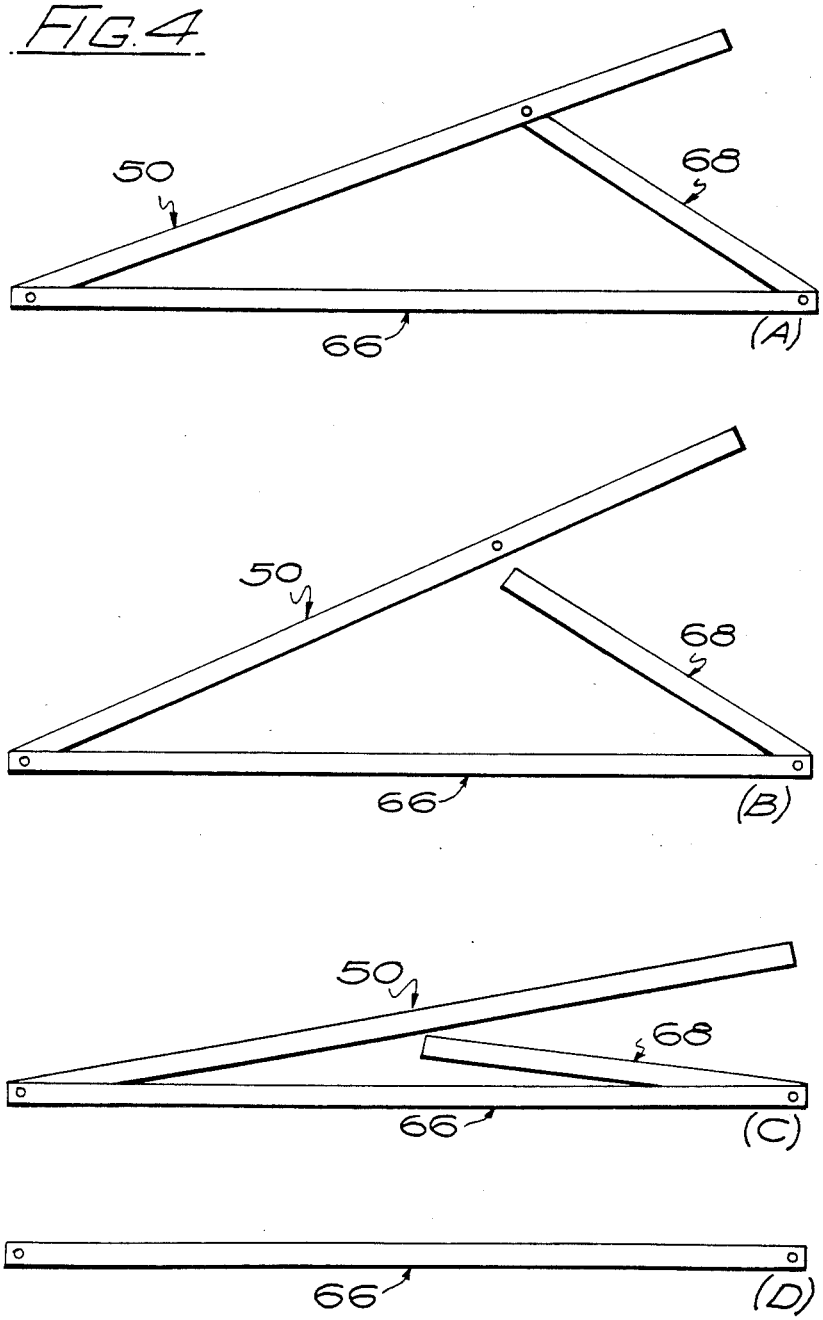

In FIG. 4 of Diagram 6, the upper frame X is pivotally connected to base pieces Z and strut frame Y, the connection between the strut frame Y and the base frame Z being a disengageable one.

Figure 5:
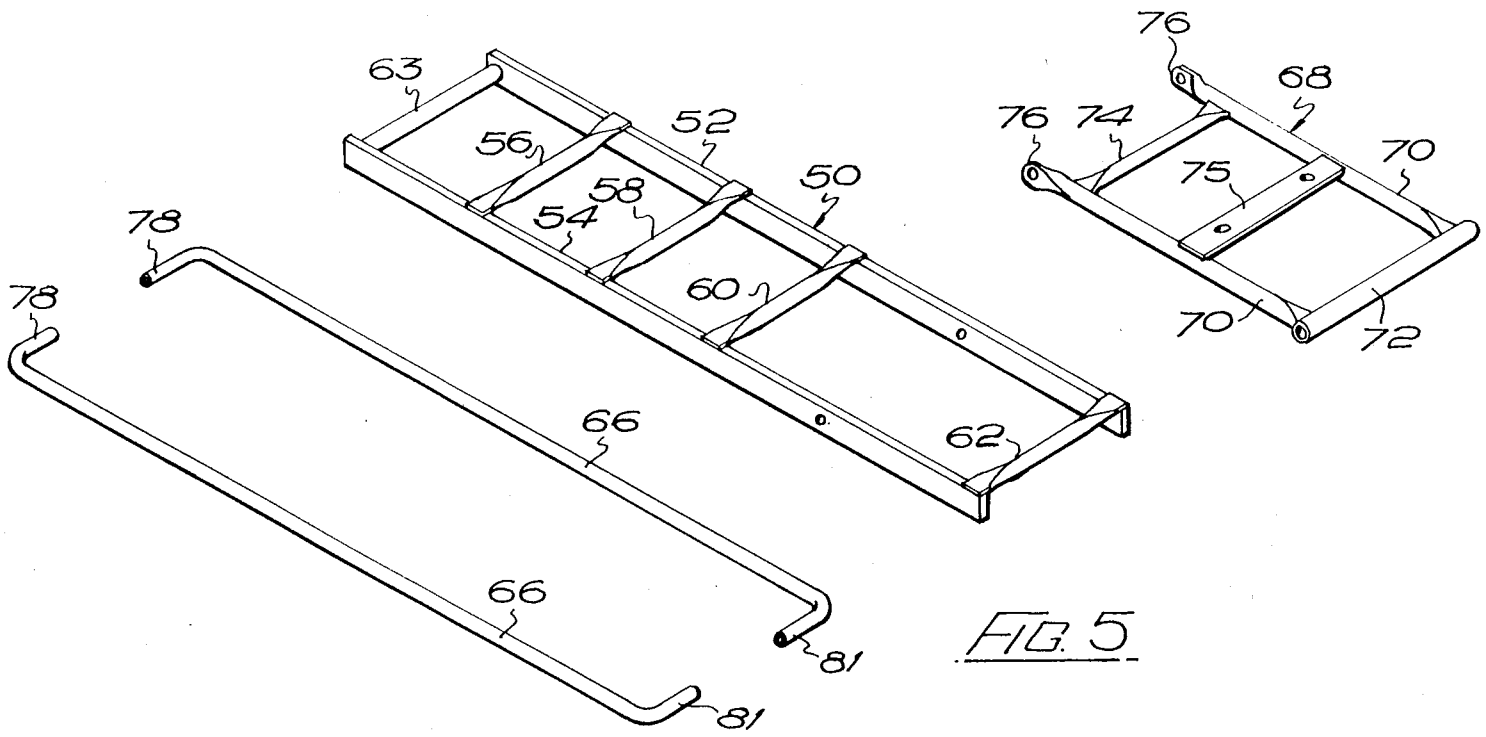

In FIG. 5 of Diagram 5, the arrangement is similar to diagram 4 except that the strut frame Y engages the base pieces Z inwardly at the rear end thereof.

Figure 6:
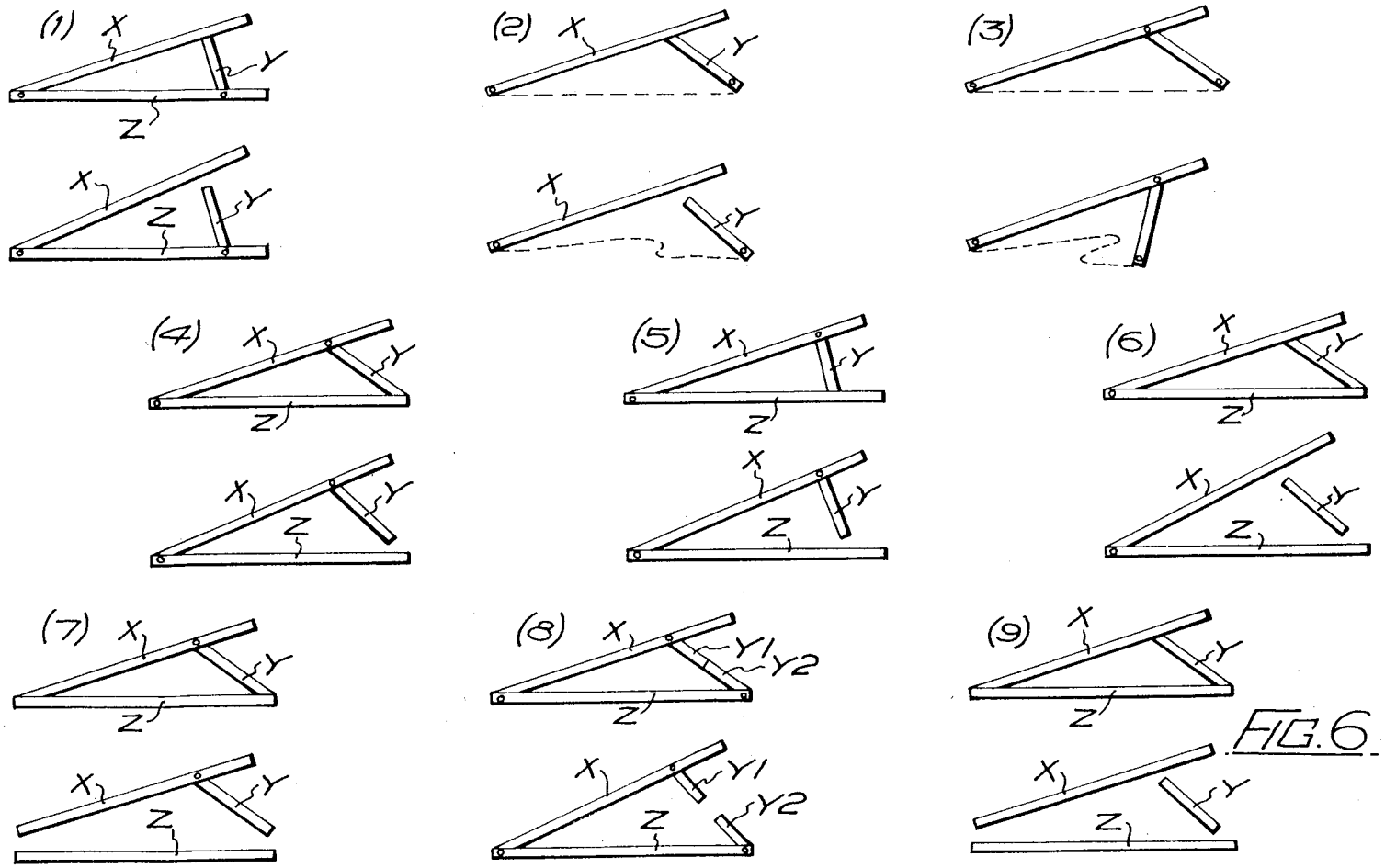

In FIG. 6 of Diagram 6, the strut frame Y is disengageably connected with each of the upper frame X and the base pieces Z, the upper frame X and base pieces Z being pivotally interconnected.

Figure 7:
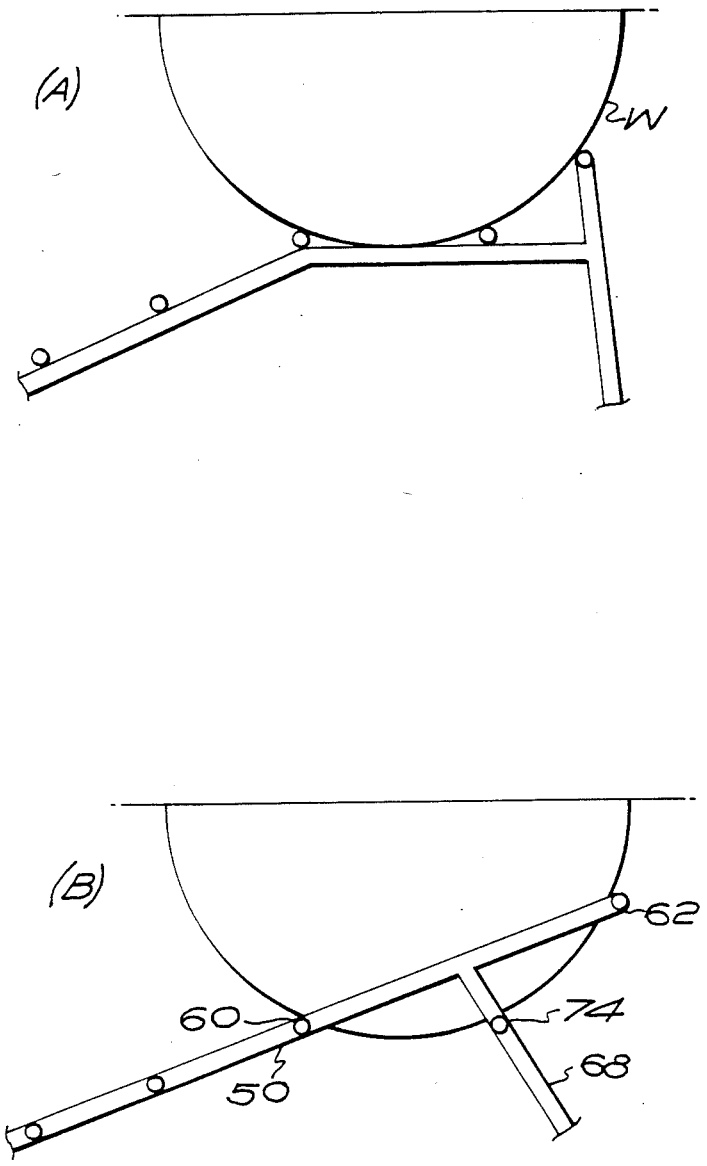

In the arrangement of FIG. 7 of Diagram 6, the upper frame X is pivotally interconnected to the strut frame Y, whilst the upper frame X of strut frame Y are disengageably connected to the base pieces Z.

In FIG. 8 of Diagram 6, the strut frame Y is in two parts Y1 and Y2 which are disengageably connected, the upper frame X being pivoted to the base pieces Z, and the strut frame parts Y1 and Y2 being pivotally connected to the upper frame X and base pieces Z respectively.

In FIG. 9 of Diagram 6, there is no pivotal interconnection between the frames X and Y and base pieces Z, the frames and base pieces merely being disengageably interconnected as shown.

In each embodiment of the invention there is the common feature as indicated in the embodiments of Diagram 2 and 2A and in FIG. B of Diagram 7 which shows that the wheel W of the vehicle engages in the well provided by the spacing of the bars 60 and 62 and also provided by the cross bar 74 of the strut frame 68. Additionally, it is desirable that the strut frame should meet the side rails 52 and 54 at a location between the spaced cross bars 60 and 62 of the upper frame, and at an acute angle, to give maximum support.

It will be seen that the invention can apply where there is only an upper frame and a strut frame, and it is not neccessary that the respective frames be pivotally interconnected. Indeed, it is not necessary that members 50 and 68 be frames; they could be plates. In each case, however, the ramp defines a well for the wheel, and it is to be mentioned that the ramp size may have to be selected so as to be capable of receiving any of a large number of vehicle wheels, and in each case the ramp can bemoved to a substantially flat condition for transportation in a vehicle boot, when the collapsed ramp according to the invention will take up only a fraction of the space which would be taken up by a conventional car ramp as shown in Diagram 1.

The joint between the respective frames, when not a pivotal joint, could be a telescopic type joint, a screw fixing in vertical or horizontal plane, or peg in hole arrangement.

The cross bars 56 to 62 of the upper frame are welded, rivotted or otherwise permanently secured to the side rails 52 and 54, and the number of cross members may be varied to suit the application.

The materials used for the frames of a car ramp according to the invention may be suitable steel members, rods or any required cross section and design, the components being welded or otherwise secured where permanent fixing is required.

I claim:

1. A vehicle wheel stand comprising:

(a) a flat upper frame; and (b) means defining a flat strut frame and the upper frame and said means defining the strut frame being positionable between;

(i) a transport position in which the strut frame and upper frame inter fit and form a substantially flat assembly which takes up a minimum of space and (ii) a second position in which, when said stand rests on the ground, the upper frame inclines upwardly from the front end on the ground to an upper rear end supported by the strut frame which extends between the rear end of the upper frame and the ground and meets the upper frame at an acute angle; and the improvement comprising that the upper frame comprises a pair of spread side rails between which extend cross bar means so that a vehicle can run up the upper frame, and at the rear end the spacing between two of said cross bar means is sized to define a well into which the vehicle wheel can drop so that the rails overlap the wheel sides as to stably hold the vehicle wheel in supported condition on flat ground, and the said two cross bar means of the upper frame are disposed on opposite sides of the location where the strut frame engages the upper frame in the second position and there is a strut cross bar which is part of the strut frame, but is located under the plane of the upper frame, and in position to lend additional support to the vehicle wheel.

2. A stand according to claim 1 wherein the strut frame is connected to the upper frame by means of releaseable screw devices.

3. A stand according to claim 1 wherein the strut frame has dowels at the end which engage the upper frame, and the said dowels releaseably engage in holes in the upper frame.

* * * * *